US007278883B2

(12) United States Patent
Tyler

(10) Patent No.: US 7,278,883 B2
(45) Date of Patent: Oct. 9, 2007

(54) ELECTRICAL CONNECTOR HOUSING WITH TERMINAL POSITION ASSURANCE (TPA) MEMBER

(75) Inventor: Adam P. Tyler, Rochester Hills, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/509,968

(22) Filed: Aug. 24, 2006

(65) Prior Publication Data

US 2007/0082548 A1 Apr. 12, 2007

Related U.S. Application Data

(60) Provisional application No. 60/720,749, filed on Sep. 26, 2005.

(51) Int. Cl.
*H01R 13/40* (2006.01)

(52) U.S. Cl. ..... 439/595

(58) Field of Classification Search ..... 439/595, 439/752

See application file for complete search history.

(56) References Cited

U.S. PATENT DOCUMENTS

| | | | | |
|---|---|---|---|---|
| 4,786,258 | A | 11/1988 | Shaffer et al. | 439/188 |
| 5,906,519 | A | 5/1999 | Nix et al. | 439/752 |
| 6,056,604 | A | 5/2000 | Roy et al. | 439/845 |
| 6,116,953 | A * | 9/2000 | Myer | 439/595 |
| 6,183,299 | B1 | 2/2001 | Ward et al. | 439/595 |
| 6,193,551 | B1 | 2/2001 | Yamamoto et al. | 439/595 |
| 6,247,975 | B1 | 6/2001 | Cue | 439/845 |
| 6,659,798 | B2 | 12/2003 | Mase et al. | 439/595 |
| 6,669,507 | B2 | 12/2003 | Yamanashi et al. | 439/595 |
| 6,695,651 | B2 | 2/2004 | Mase et al. | 439/752 |
| 6,736,675 | B2 | 5/2004 | Kato et al. | 439/595 |
| 6,881,103 | B2 | 4/2005 | Dawidziuk | 439/752 |
| 6,913,494 | B2 | 7/2005 | Ward et al. | 439/752 |
| 2002/0061675 | A1 | 5/2002 | Borst | 439/404 |
| 2002/0076992 | A1 | 6/2002 | Kurimoto et al. | 439/752 |
| 2002/0127913 | A1 | 9/2002 | Ichio | 439/595 |
| 2004/0192108 | A1* | 9/2004 | Ward et al. | 439/595 |
| 2005/0085127 | A1 | 4/2005 | Maeda | 439/595 |
| 2005/0176298 | A1* | 8/2005 | Flowers et al. | 439/595 |
| 2005/0215106 | A1 | 9/2005 | Holub | 439/357 |
| 2005/0227548 | A1* | 10/2005 | Sian | 439/752 |
| 2006/0063414 | A1* | 3/2006 | Goto | 439/298 |

* cited by examiner

*Primary Examiner*—Tulsidas C. Patel
*Assistant Examiner*—Vladimir Imas
(74) *Attorney, Agent, or Firm*—Harrington & Smith, PC

(57) ABSTRACT

An electrical connector including a plurality of electrical terminals; and a housing having the electrical terminals connected thereto. The housing includes a first housing member and a second housing member movably connected to the first housing member. The first housing member includes snap-lock latches which lock the terminals in terminal receiving channels of the first housing member. The terminal receiving channels include a first row of the terminal receiving channels with a first one of the terminal receiving channels and a second one of the terminal receiving channels being separated from each other by a wall of the first housing member, and the first housing member having a substantially open wall area between a third one of the terminal receiving channels and the second terminal receiving channel. The second housing member is adapted to at least partially close the open wall area.

20 Claims, 12 Drawing Sheets

ELECTRICAL CONNECTOR HOUSING WITH TERMINAL POSITION ASSURANCE (TPA) MEMBER

CROSS REFERENCE TO RELATED APPLICATION

This application claims priority under 35 U.S.C. §119(e) to U.S. provisional patent application No. 60/720,749 filed Sep. 26, 2005 which is hereby incorporated by reference in its entirety.

BACKGROUND OF THE INVENTION

1. Field of the Invention

The invention relates to electrical connectors and, more particularly, to an electrical connector housing with a terminal position assurance (TPA) member.

2. Brief Description of Prior Developments

U.S. Patent Publication No. 2005/0085127 A1 discloses a connector having a housing and a movable front retainer. The front retainer is pushed inward to a full locking position after all the terminals have been inserted into the housing.

There is a continuing desire to provide electrical connectors in ever decreasing smaller sizes. However, electrical contacts of electrical connectors still need to be electrically separated or isolated from each other. In addition, a terminal position assurance (TPA) feature is a desired feature in some types of electrical connector to assure full insertion of a contact or terminal into an electrical connector housing to form the electrical connector. Thus, there is a need to provide an electrical connector which has a smaller size than a conventional connector, but still has its electrical terminals separated from each other and has a TPA feature.

SUMMARY OF THE INVENTION

In accordance with one aspect of the present invention, an electrical connector is provided including a plurality of electrical terminals; and a housing having the electrical terminals connected thereto. The housing includes a first housing member and a second housing member movably connected to the first housing member. The first housing member includes snap-lock latches which lock the terminals in terminal receiving channels of the first housing member. The terminal receiving channels include a first row of the terminal receiving channels with a first one of the terminal receiving channels and a second one of the terminal receiving channels being separated from each other by a wall of the first housing member, and the first housing member having a substantially open wall area between a third one of the terminal receiving channels and the second terminal receiving channel. The second housing member is adapted to at least partially close the open wall area.

In accordance with one aspect of the present invention, an electrical connector is provided including a plurality of electrical terminals; and a housing having the electrical terminals mounted thereto. The housing comprises a first housing member and a second housing member movably connected to the first housing member. The first housing member comprises terminal receiving areas and snap-lock latches which lock the terminals in the terminal receiving areas. The first and second housing members form a terminal position assurance (TPA) feature. Portions of the first and second housing members form contact lead-in surfaces to apertures into the terminal receiving areas at a front end of the housing. The contact lead-in surfaces of at least one of the portions have a general cross-shape when viewed from the front end.

In accordance with another aspect of the invention, an electrical connector is provided comprising a plurality of electrical terminals; and a housing having the electrical terminals connected thereto. The housing comprises a first housing member and a second housing member movably connected to the first housing member. The first housing member comprises terminal receiving areas and snap-lock latches which lock the terminals in the terminal receiving areas. The first and second housing members form a terminal position assurance feature. The terminal receiving areas comprise a first row of the terminal receiving channels with a first one of the terminal receiving channels and a second one of the terminal receiving channels being separated from each other by a wall of the first housing member and the first housing member having a substantially open wall area between a third one of the terminal receiving channels and the second terminal receiving channel. The second housing member is adapted to at least partially close the open wall area. Portions of the first and second housing members form contact lead-in surfaces to apertures into the terminal receiving channels at a front end of the housing. At least one of the portions of the first and second housing members have a general cross-shape when viewed from the front end.

DETAILED DESCRIPTION OF THE PREFERRED EMBODIMENT

Figure 1:
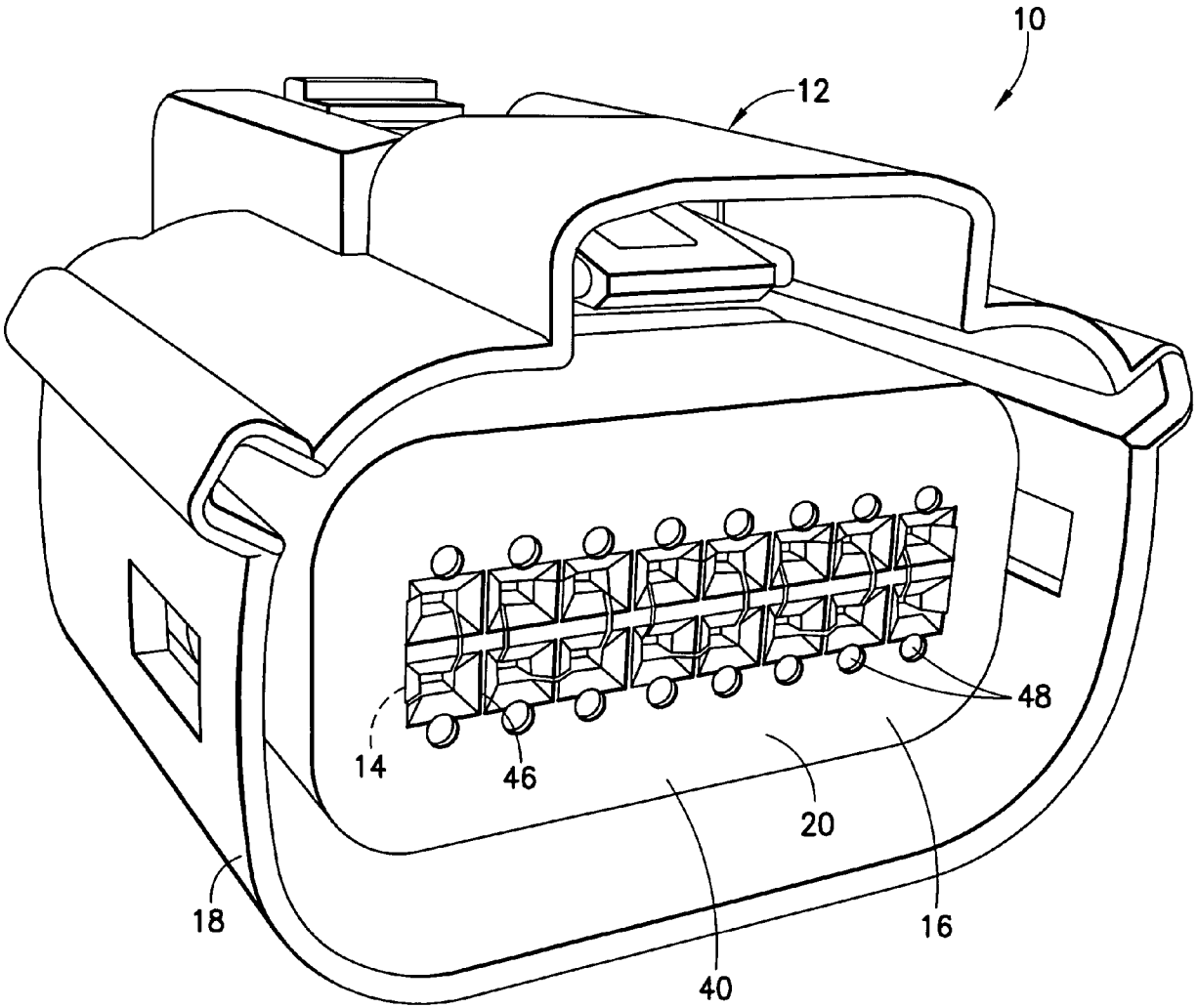
FIG. 1 is a perspective view of an electrical connector comprising features of the invention.

Referring to FIG. 1, there is shown a perspective view of an electrical connector 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

Figure 5:
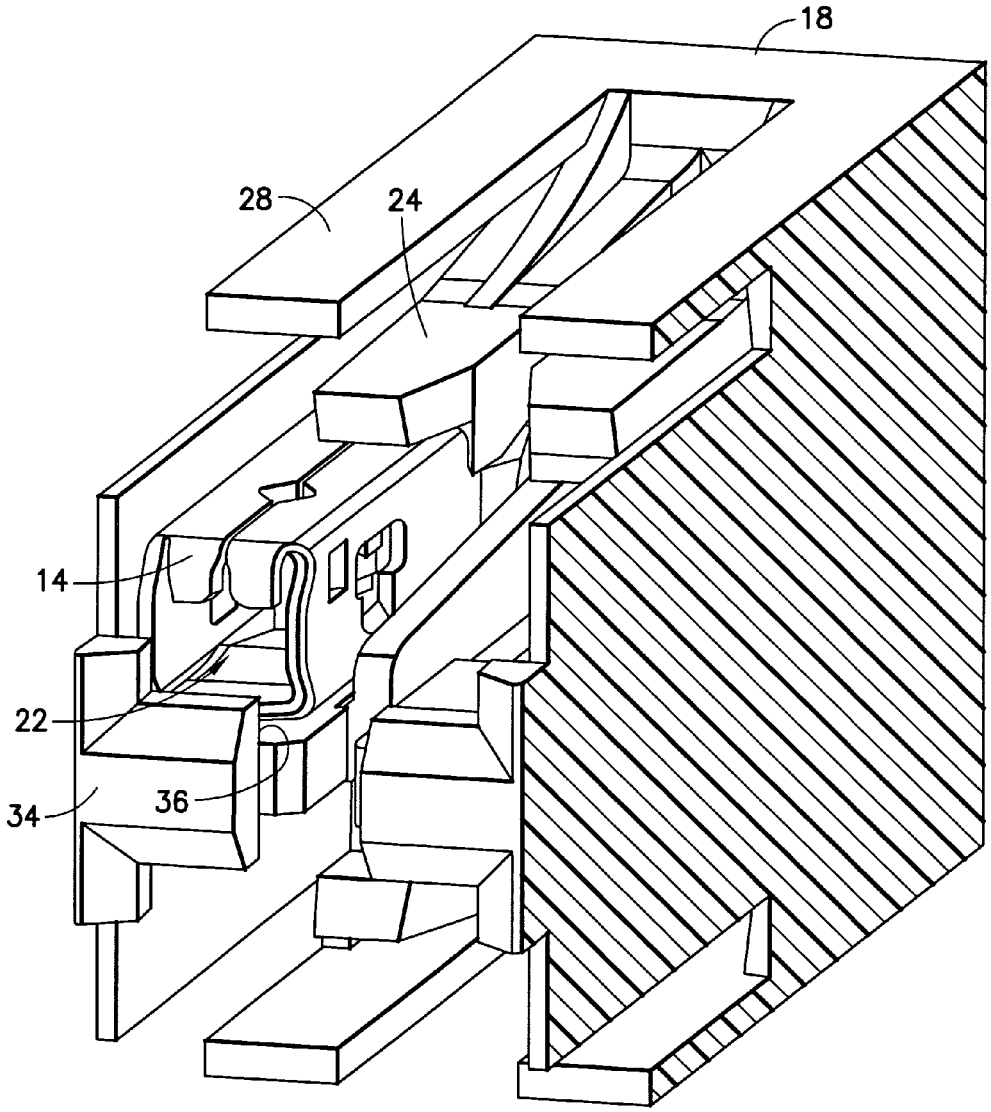
FIG. 5 is a perspective view as in FIG. 4 showing one of the terminals inserted into the first housing member.

The electrical connector 10 generally comprises a housing 12 and electrical contacts or terminals 14 (see FIG. 5) located inside the housing. The terminals 14 are preferably female terminals, such as disclosed in U.S. Pat. Nos. 6,056,604 and 6,247,975 for example which are hereby incorporated by reference in their entireties. However, any suitable terminal(s) could be provided. The connector could also comprise additional components or members. The connector 10 is adapted to removably connect electrical wires or conductors (not shown) to a mating electrical connector (not shown). The front end 16 of the connector 10 is adapted to mate with the mating electrical connector. A similar connector and mating connector are described in U.S. patent application Ser. No. 10/806,731 (US 2005/0215106 A1) which is hereby incorporated by reference in its entirety.

Figure 2:
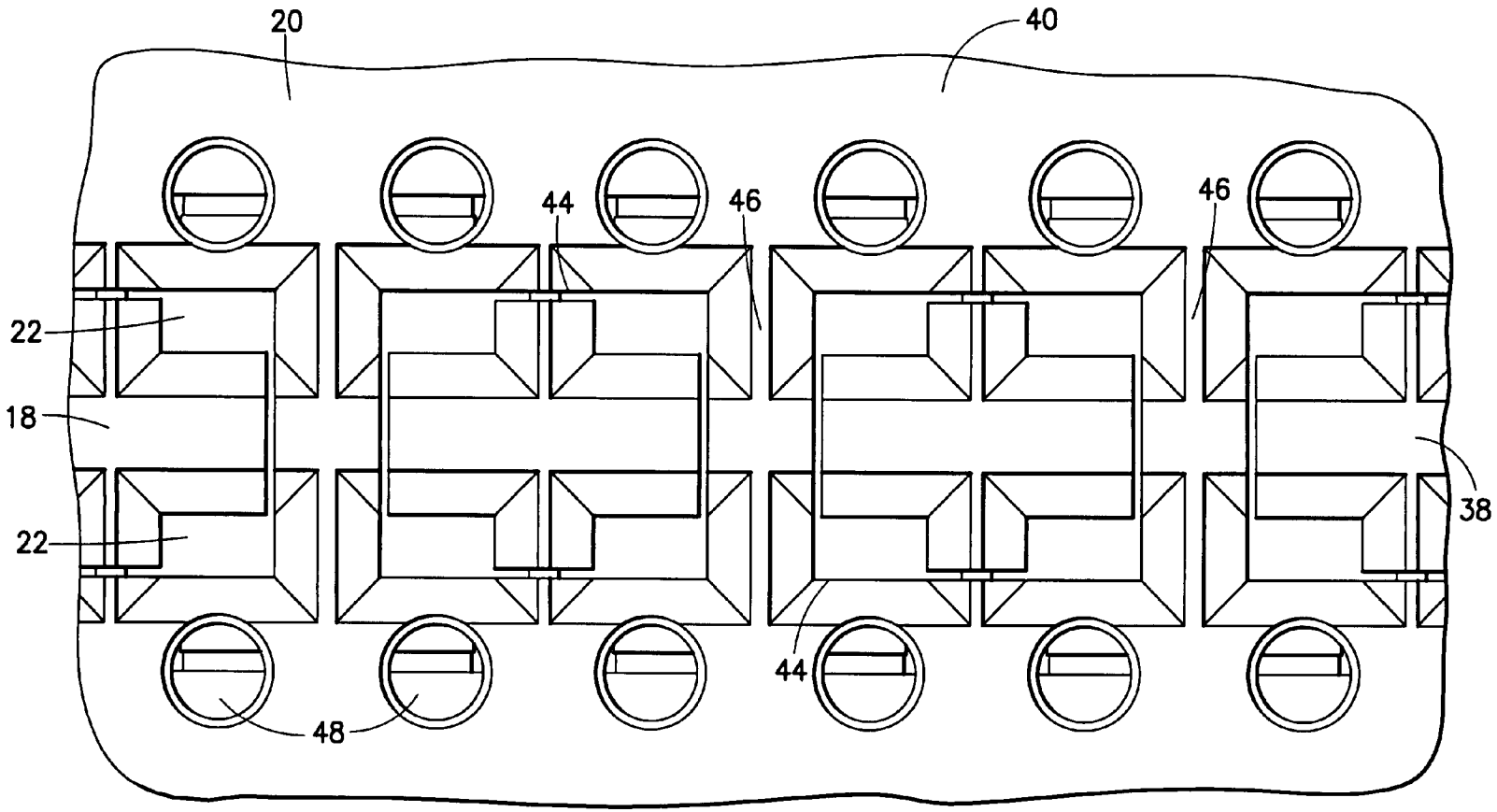
FIG. 2 is an enlarged partial front end view of the connector shown in FIG. 1.

Referring also to FIG. 2, the housing 12 generally comprises a first housing member 18 and a second housing member 20. The first housing member 12 forms a majority of the housing. The second housing member 20 forms a terminal position assurance (TPA) member as well as part of the housing. As further described below, the second housing member 20 is movably mounted to the first housing member 18 at the front end 16 between a forward unlocked position and a rearward locked position. FIG. 1 shows the second housing member 20 in its rearward locked position. The terminals 14 are attached to the wires (not shown) and then inserted into the first housing member 18 through the rear end of the first housing member 18. The second housing member 20 is then moved from its forward unlocked position to its rearward locked position to thereby assure that the terminals 14 are locked inside the housing 10.

Figure 3:
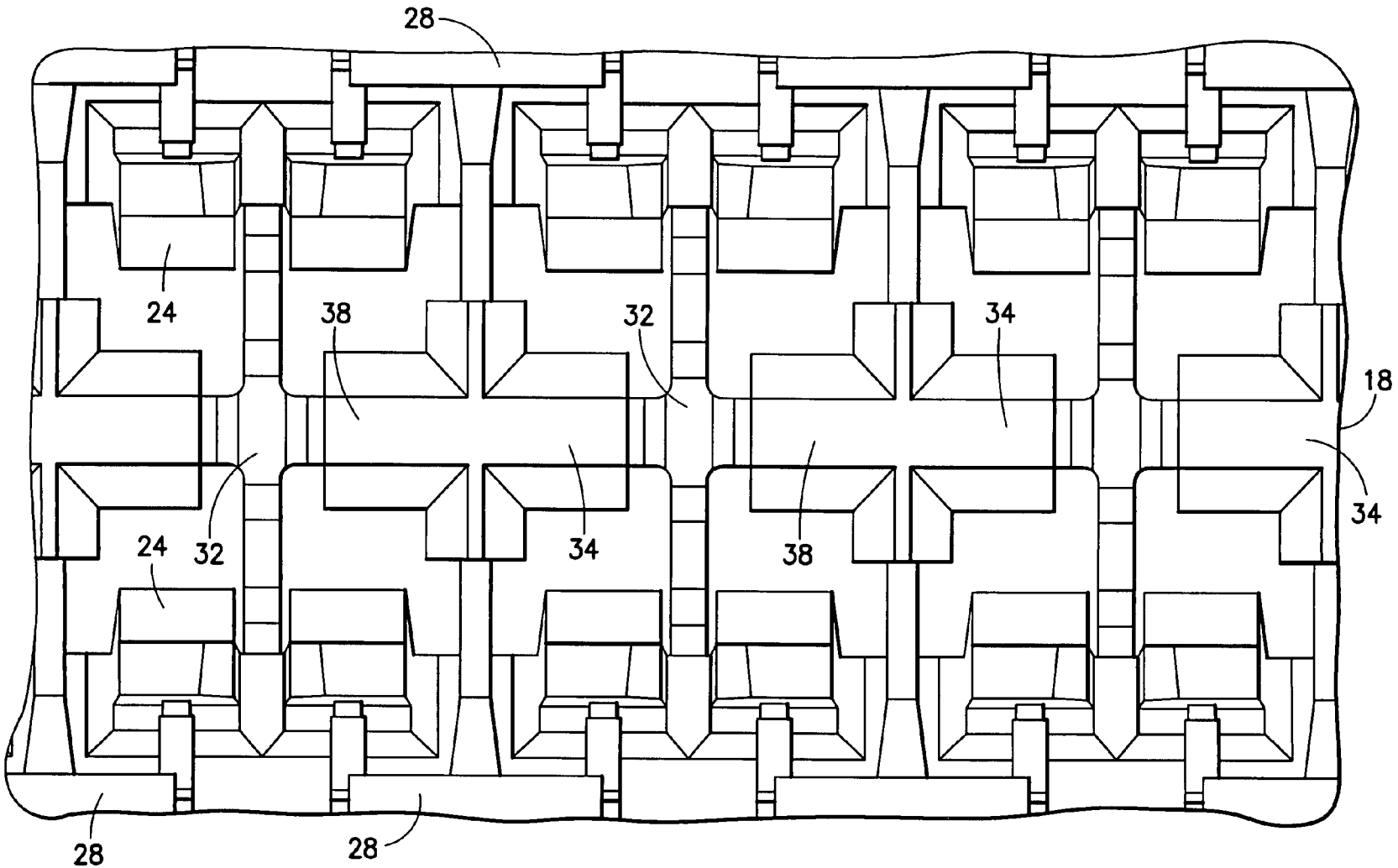
FIG. 3 is a partial front end view similar to FIG. 2 of the first housing member of the connector.
Figure 4:
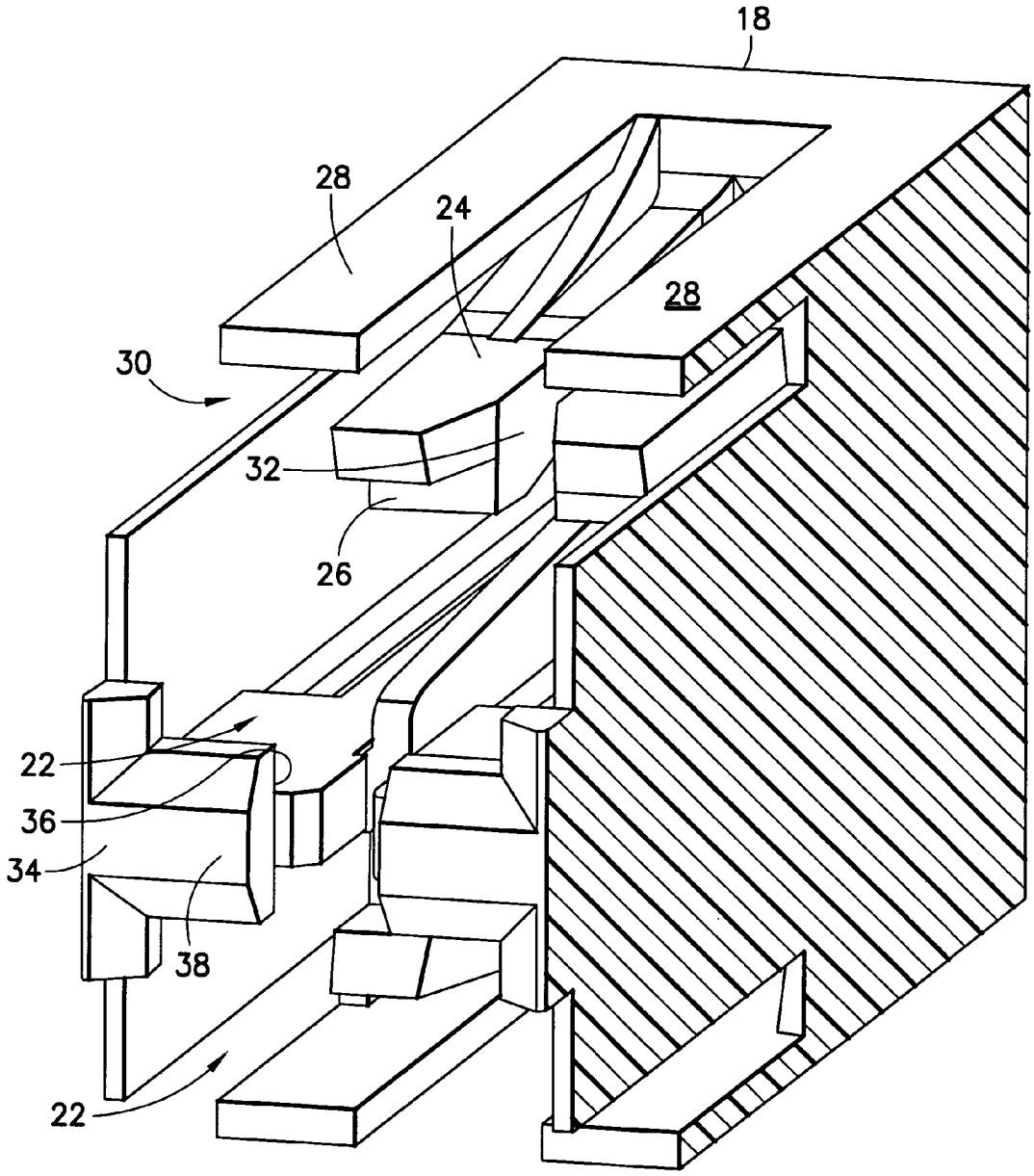
FIG. 4 is a perspective view of a portion of the first housing member shown in FIG. 3.

Referring also to FIGS. 3 and 4, the first housing member 18 is preferably a one-piece molded plastic member. However, in alternate embodiments the first housing member could be comprised of multiple members, any suitable material(s) and/or could be formed by any suitable forming process. The first housing member 18 comprises a plurality of terminal receiving channels 22. The rear ends of the channels 22 are relatively open such that the terminals 14 can be inserted into the channels 22 through the rear end of the first housing member 18.

The first housing member 18 includes terminal locking fingers 24 which extend into each of the channels 22. Each terminal locking fingers 24 comprises a forward projecting cantilevered deflectable section with a front facing latch surface 26. The first housing member 18 includes overtravel protection sections 28 for each of the terminal locking fingers 24. The overtravel protection sections 28 are located outward from the terminal locking fingers 24 and spaced from the terminal locking fingers 24 by a gap 30. Open slots 32 are provided in the first housing member 18 between adjacent ones of the terminal locking fingers 24. The slots 32 also partially open alternating adjacent ones of the channels 22 to each other.

The terminal locking fingers 24 are adapted to resiliently deflect into the gaps 30 during insertion of the terminals 14 into the channels 22. As seen with reference to FIG. 5, the fingers 24 subsequently snap back to their home undeflected positions after the terminals are inserted with the latch surfaces 26 latched behind a portion of the terminals. This prevents the terminals 14 from inadvertently being pushed or pulled out of the rear end of the channels 22.

The front end of the first housing member 18 includes forward stop sections 34. The forward stop sections 34 have a general plus sign or cross (+) shape except at the lateral ends where the forward stop sections 34 have one-half general plus sign (+) or cross shapes. The full plus sign (+) shaped forward stop sections 34 are located at the front of four of the channels 22. The one-half plus sign (+) shaped forward stop sections 34 are located at the front of two of the channels 22; the two channels at each lateral end of the rows. As seen with reference to FIG. 5, the back sides 36 of the forward stop sections 34 form stop surfaces to limit forward movement of the terminals 14 in the channels 22. The back sides of the forward stop sections 34 are only located on two of the sides of each channel. The front sides 38 of the forward stop sections 34 comprise sloped surfaces as lead-ins for the male contacts of the mating electrical connector (not shown) into the channels 22 and terminals 14.

Figure 6:
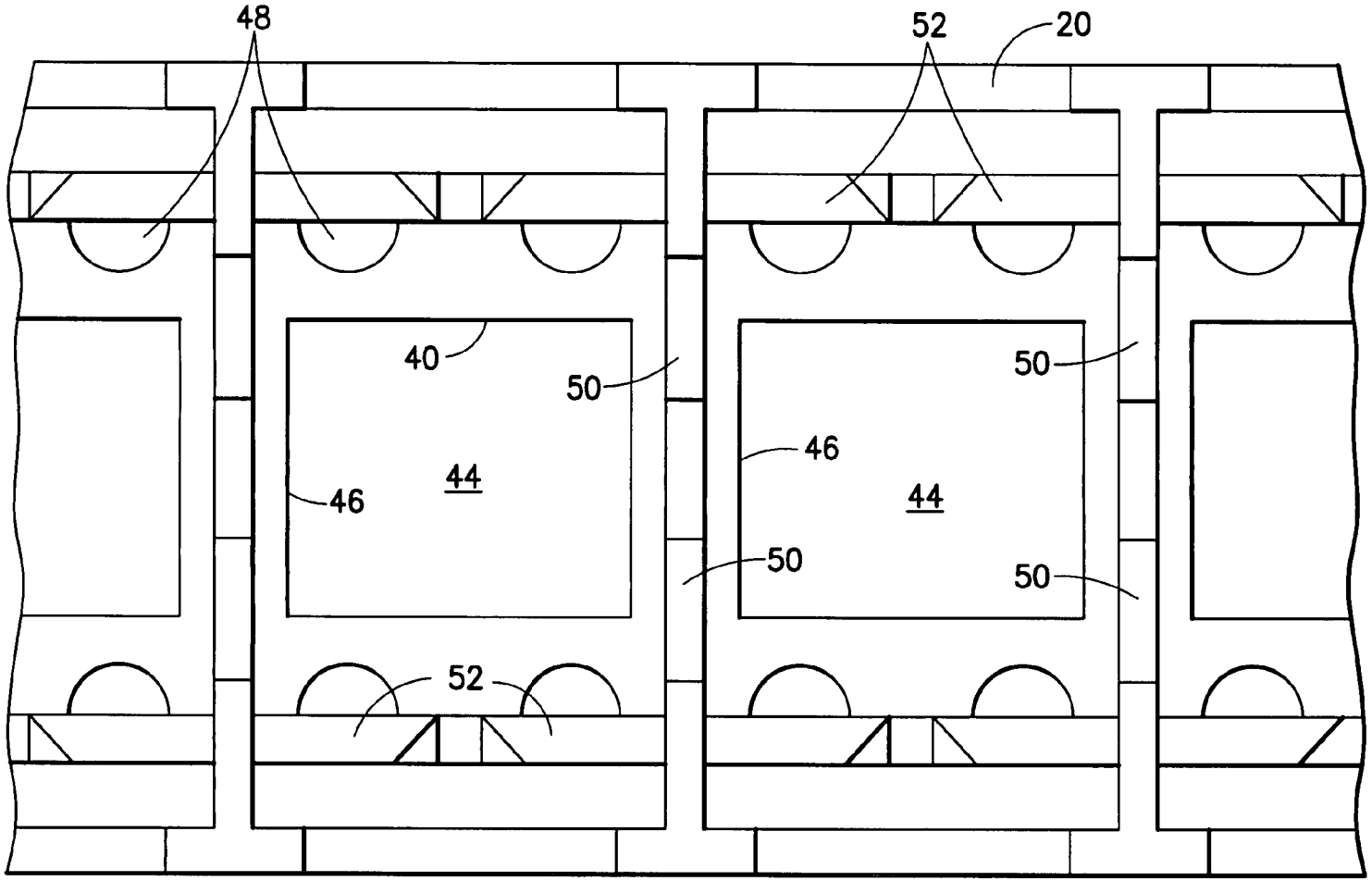
FIG. 6 is a partial rear end view of the second housing member shown in FIG. 1.
Figure 7:
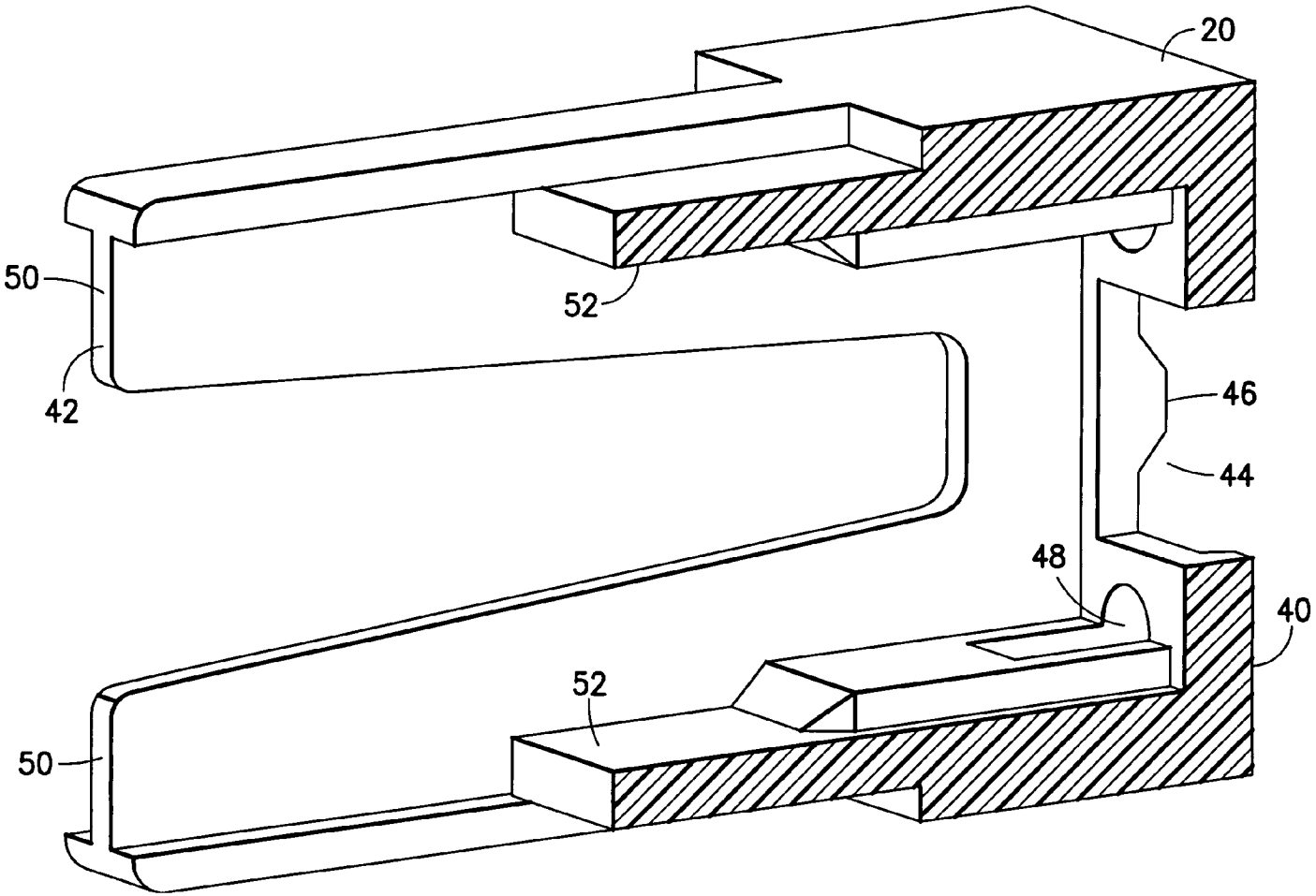
FIG. 7 is a perspective cut away view of the second housing member shown in FIGS. 1 and 6.
Figure 8:
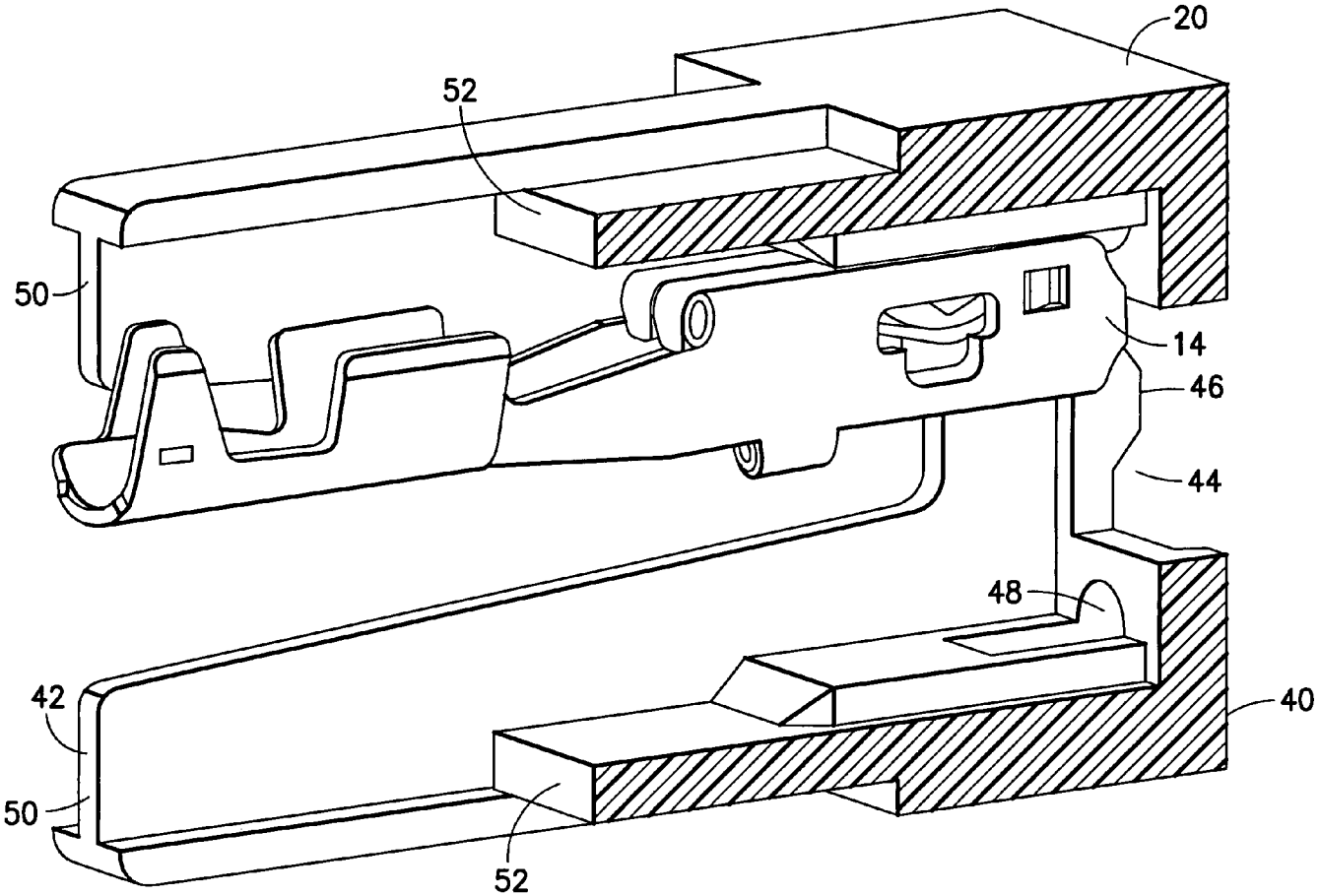
FIG. 8 is a perspective cut away view of the second housing member as in FIG. 7 showing location of one of the terminals when the second housing member is in a rearward locked position.
Figure 9:
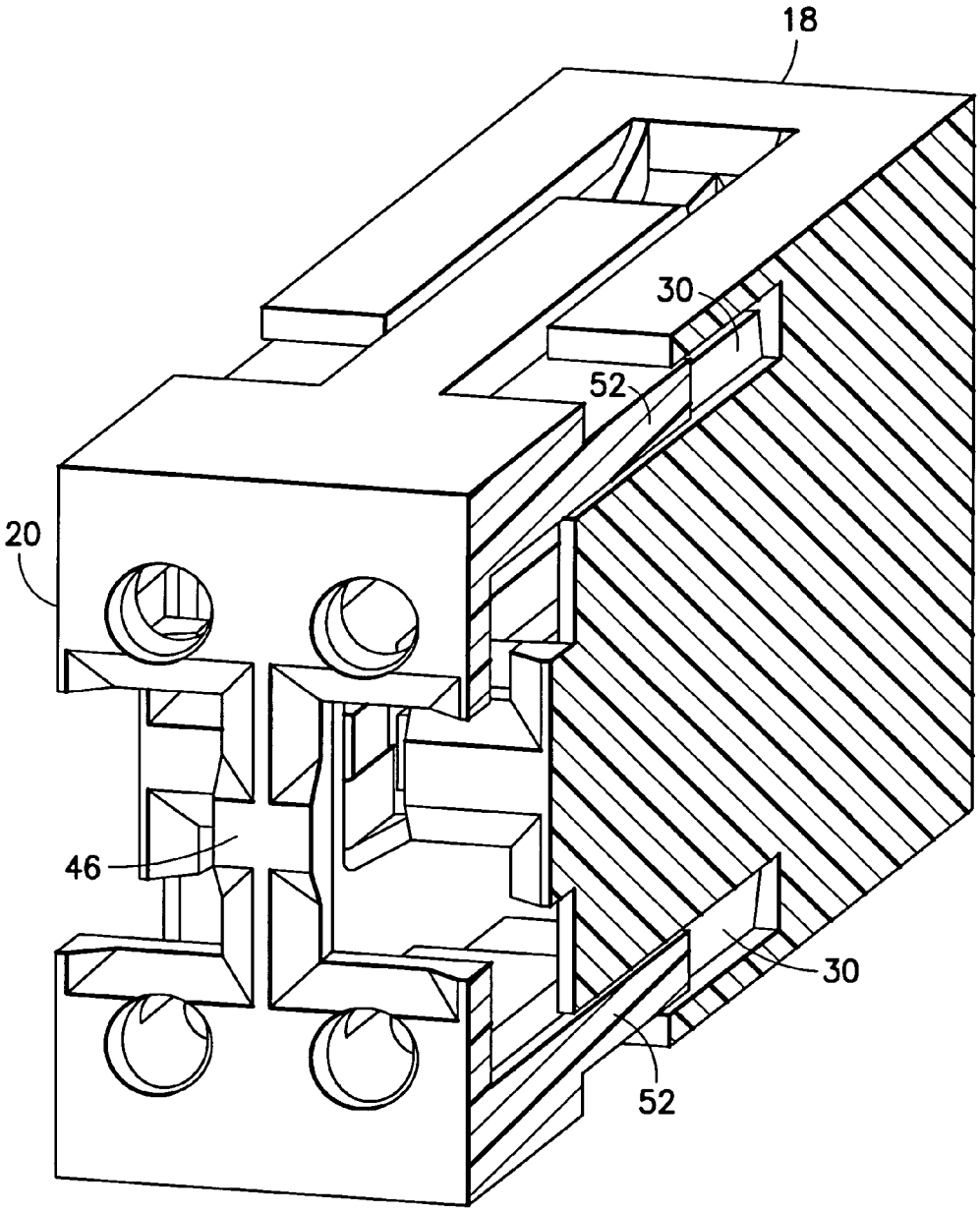
FIG. 9 is a partial perspective cut away view of the second housing member at a forward unlocked position on the first housing member.
Figure 10:
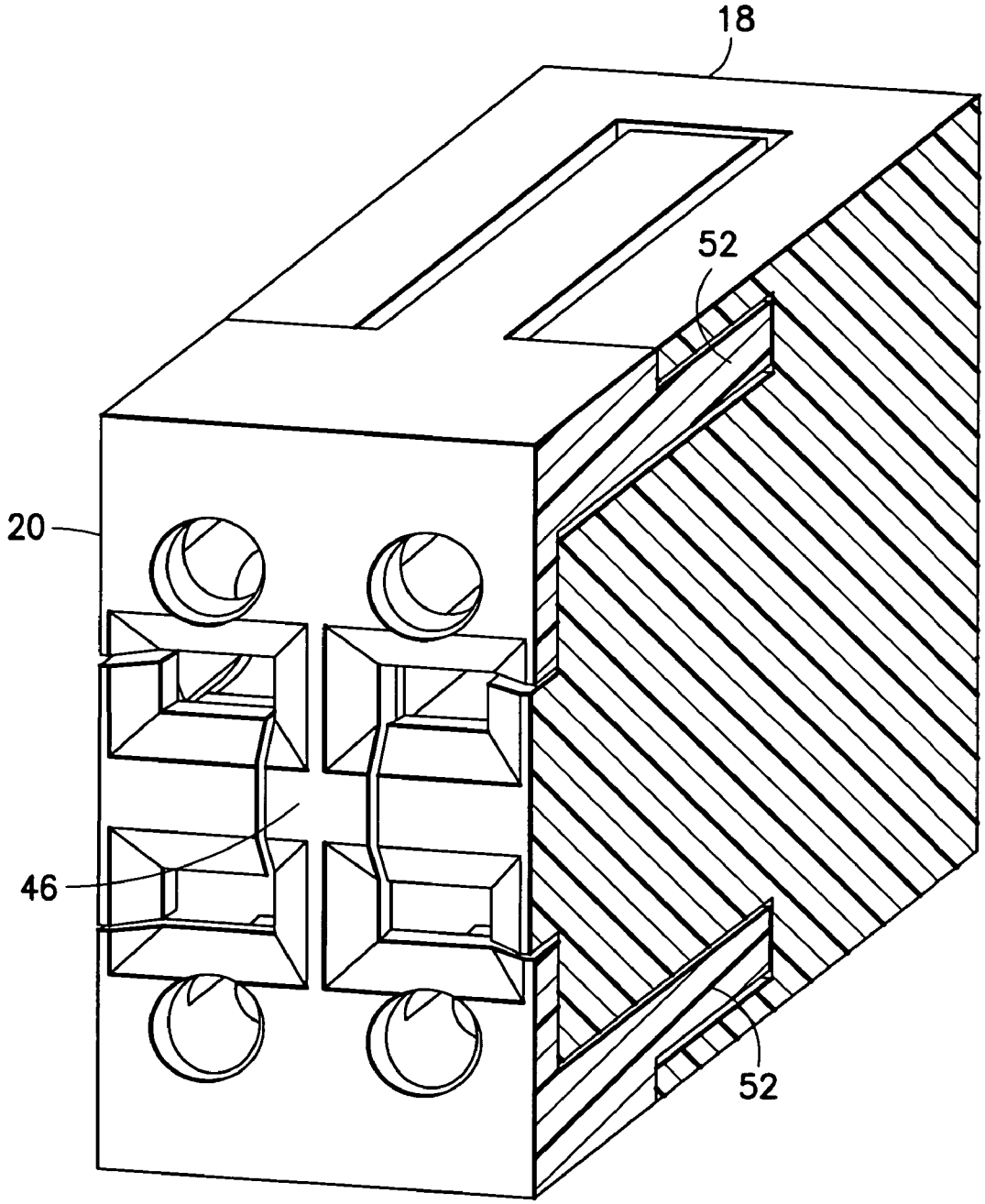
FIG. 10 is a partial perspective cut away view as in FIG. 9 showing the second housing member at a rearward locked position on the first housing member.
Figure 11:
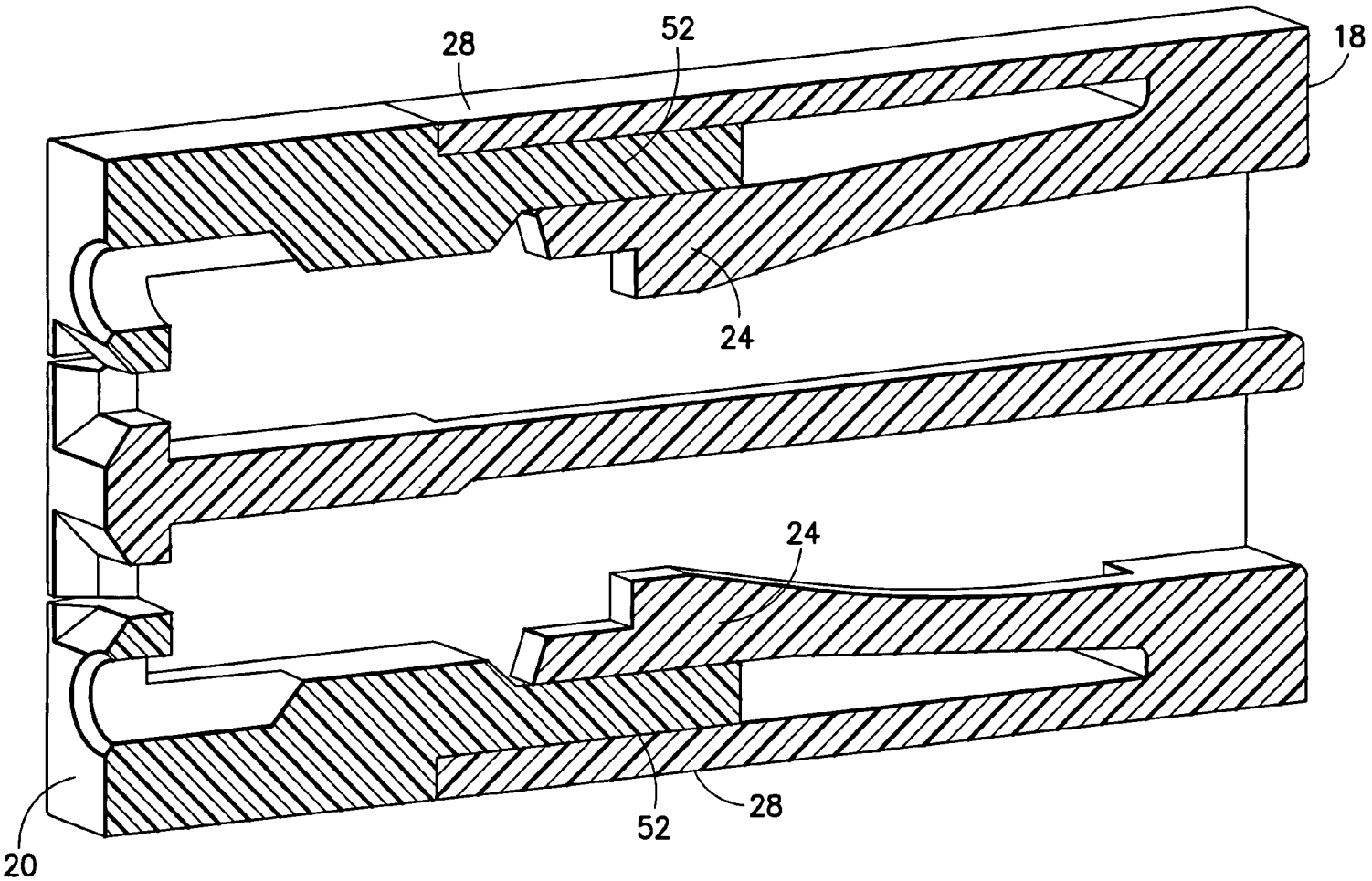
FIG. 11 is a cross sectional view of the first and second housing members at a locked position without showing the terminals merely for the sake of clarity.
Figure 12:
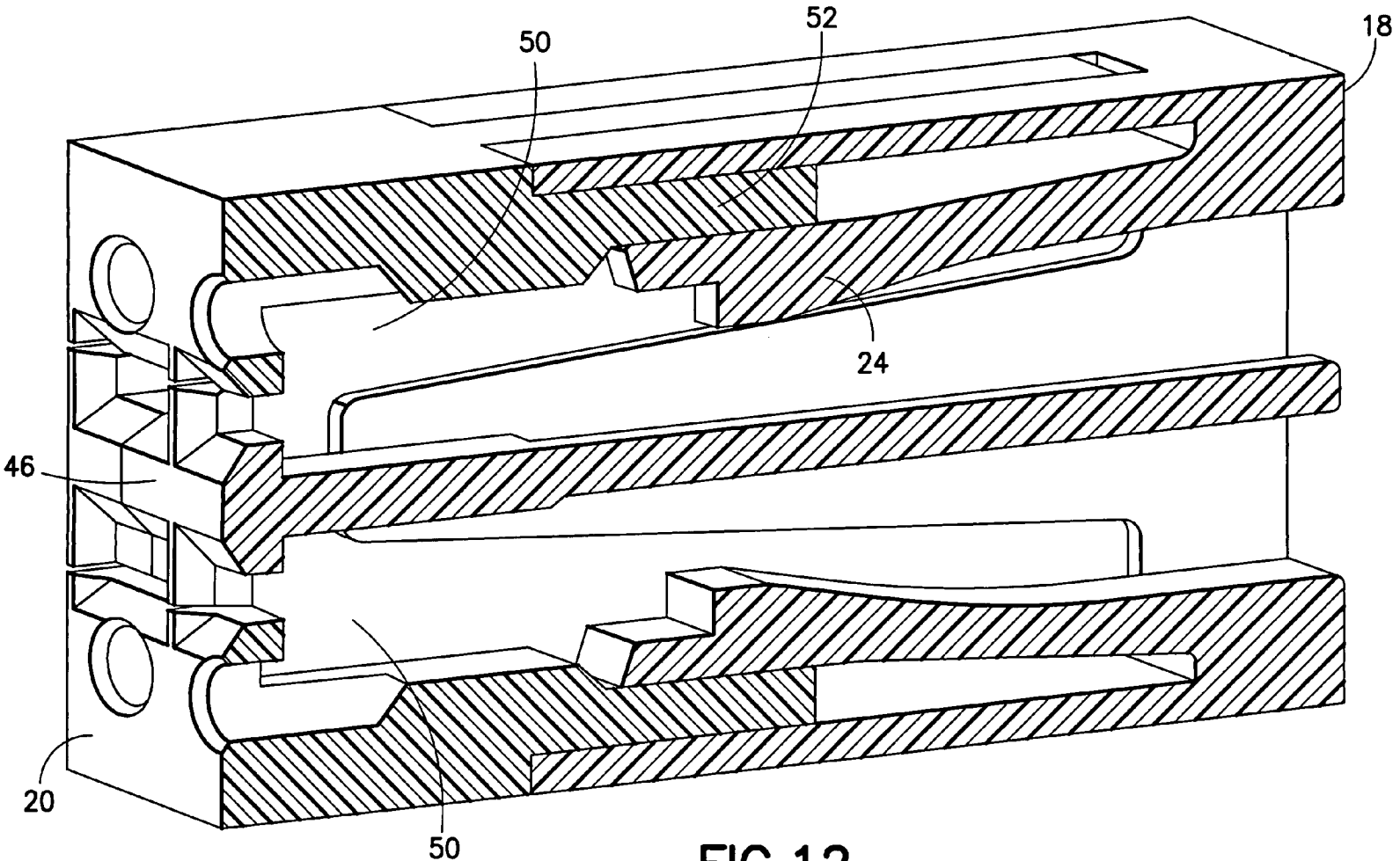
FIG. 12 is a cross sectional view of the first and second housing members similar to FIG. 11 at another location on the housing showing how the second housing member forms portions of the side walls of the terminal receiving channels.

Referring also to FIGS. 6 and 7, the second housing member or TPA member 20 is preferably a one-piece molded plastic member. However, in alternate embodiments the second housing member could be comprised of multiple members, any suitable material(s) and/or could be formed by any suitable forming process. The second housing member 20 comprises a front end 40 and rearward extending sections 42. The front end 40 includes general box shaped openings 44 with columns 46 located between the openings 44. The columns 46 have front faces with sloped lead-in surfaces as lead-ins for the male contacts of the mating electrical connector (not shown) into the channels 22 and terminals 14. The front faces of the second housing member 20 also includes top and bottom sloped surfaces at the top and bottoms of the openings 44. When the second housing member 20 is moved to its locked position as seen in FIG. 1, the sloped surfaces of the two housing members 18, 20 combine to form square or rectangular funnel shapes into the channels 22 at the front of the connector. Pogo style electrical testing holes 48 are located above and below the openings 44 to allow an electrical testing probe (not shown) to be inserted into the housing to test the terminals 14. As seen with reference to FIG. 8, the rear side of the front end 40 forms stop surfaces for limiting forward movement of the terminals 14 in the channels 22 when the second housing member 20 is located at its locked position, but only on two sides of each channel 22.

The rearward extending sections 42 include rearward extending cantilevered channel separator wall sections 50 and rearward extending cantilevered blocking sections 52. The wall sections 50 are adapted to be located in the slots 32 of the first housing member 18. The wall sections 50 can slide in the slots 32. When the second housing member 20 is at its locked position, the wall sections 50 cooperate with the first housing member 18 to separate at least some of the adjacent channels 22 from each other. By allowing portions of the second housing member 20 to be used to separate at least some of the channels 22 from each other (rather than only the first housing member) the overall size of the connector 10 can be reduced. In the embodiment shown, the lateral side walls of the channels 22 are provided either by the first housing member 18 and alternatingly by portions of the first housing member 18 and the wall sections 50 of the second housing member 20. Alternatively, the wall sections of the second housing member could form the alternating channels walls entirely.

Referring also to FIGS. 9-12, when the second housing member 20 is initially inserted into the first housing member 18, the blocking sections 52 are located in the areas just forward of the gaps 30; partially covered by the overtravel protection sections 28. When the second housing member 20 is moved to it locked position, the blocking sections 52 slide into the gaps 30. If any of the terminals 14 are not fully inserted into the channels 22, their respective locking finger 24 will prevent insertion of the blocking section 52 into the gap. This can signal the installer that there is a terminal which is not fully inserted.

When the blocking sections 52 are moved into the gaps 30, the blocking sections prevent or block outward deflection of the locking fingers 24. Because the locking fingers 24 are prevented from deflecting outward by the blocking sections 52, the locking fingers 24 cannot be inadvertently moved and they positively prevent the terminals 14 from being pushed or pulled out of the rear ends of the channels. Thus, the blocking sections 52 provide locking finger reinforcement.

With the embodiment shown in the drawings, the first housing member or terminal block 18 defines two partial, right angle walls of each cavity leading into the channels 22 and the terminals 14. The TPA member 20 defines the rest of the cavity leading into the channels 22 and the terminals 14; including the other two partial, right angle walls of each cavity. The two partial, right angle walls of the first housing member 18 help prevent the terminals 14 from popping out of the front end of the first housing member 18 prior to insertion of the TPA member 20. Once the TPA member 20 is inserted, the two members 18, 20 define a 360° contact stop surface at the front of the channels 22. In addition, the TPA member 20 defines a portion of each alternating channel wall. By putting portions of the channel walls on the TPA member 20, there is more space in the first housing member for insertion of the terminals 14 and wider flexible locking fingers 24. More space in the first housing member for insertion of the terminals 14 allows larger terminals or less likelihood of clearance problems when inserting the terminals. Wider flexible locking fingers 24 can provide stronger finger which are less likely to fail, and can latch with the terminals better, such as due to an increased area of contact between the terminal and the locking finger.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a plurality of electrical terminals; and a housing having the electrical terminals connected thereto, wherein the housing comprises a first housing member and a second housing member movably connected to the first housing member, wherein the first housing member comprises snap-lock latches which lock the terminals in terminal receiving channels of the first housing member and the first and second housing members form a terminal position assurance (TPA) feature, wherein the terminal receiving channels comprise a first row of the terminal receiving channels with a first one of the terminal receiving channels and a second one of the terminal receiving channels being separated from each other by a wall of the first housing member, and the first housing member having a substantially open wall area between a third one of the terminal receiving channels and the second terminal receiving channel, wherein the second housing member is adapted to at least partially close the open wall area, and wherein the first housing member and the second housing member are configured to contact front ends of the terminals.

2. An electrical connector as in claim 1 wherein the TPA feature comprises blocking portions on the second housing member being adapted to be positioned in a gap between the snap-lock latches and another portion of the first housing member when the second housing member is moved from a forward unlocked position to a rearward locked position.

3. An electrical connector as in claim 1 wherein the terminal receiving channels comprise a second row of the terminal receiving channels which are substantially a mirror image of the first row.

4. An electrical connector as in claim 1 wherein the second housing member comprises testing holes in a front face of the second housing member into respective ones of the terminal receiving channels.

5. An electrical connector as in claim 1 wherein portions of the first and second housing members form contact lead-in surfaces to apertures into the terminal receiving channels at a front end of the housing.

6. An electrical connector as in claim 5 wherein at least one of the portions of the first and second housing members have a general cross-shape when viewed from the front end.

7. An electrical connector as in claim 6 wherein lateral ends of the row have the first housing member with general one-half cross shapes.

8. An electrical connector as in claim 1 wherein the housing comprises apertures at a front end of the housing into the terminal receiving channels, and wherein each aperture has two sides formed by the first housing member and two sides formed by the second housing member.

9. An electrical connector comprising:

a plurality of electrical terminals; and a housing having the electrical terminals mounted thereto, wherein the housing comprises a first housing member and a second housing member movably connected to the first housing member, wherein the first housing member comprises terminal receiving areas and snap-lock latches which lock the terminals in the terminal receiving areas, wherein the first and second housing members form a terminal position assurance (TPA) feature, wherein portions of the first and second housing members form contact lead-in surfaces to apertures into the terminal receiving areas at a front end of the housing, wherein the front end of the housing is adapted to mate with a mating electrical connector, and wherein the contact lead-in surfaces of at least one of the portions have a general cross-shape when viewed from the front end, wherein the terminal receiving channels comprise first row of the terminal receiving channels with a first one of the terminal receiving channels and a second one of the terminal receiving channels being separated from each other by a wall of the first housing member, and the first housing member having a substantially open wall area between a third one of the terminal receiving channels and the second terminal receiving channel, and wherein the second housing member is adapted to at least partially close the open wall area when the second housing member is moved from a forward unlocked position to a rearward locked position.

10. An electrical connector as in claim 9 wherein the lead-in surfaces of the portion of the first housing member comprises the general cross-shape.

11. An electrical connector as in claim 10 wherein the terminal receiving areas are aligned in two rows with lateral ends of the rows having the first housing member with general one-half cross shapes.

12. An electrical connector as in claim 9 wherein each aperture has two of the lead-in surfaces formed by the first housing member and two of the lead-in surfaces formed by the second housing member.

13. An electrical connector as in claim 9 wherein the second housing member comprises testing holes in a front face of the second housing member into respective ones of the terminal receiving channels.

14. An electrical connector as in claim 9 wherein the terminal receiving channels comprise a second row of the terminal receiving channels which are substantially a mirror image of the first row.

15. An electrical connector as in claim 9 wherein the TPA feature comprises blocking portions on the second housing member being adapted to be positioned in a gap between the snap-lock latches and another portion of the first housing member when the second housing member is moved from a forward unlocked position to a rearward locked position.

16. An electrical connector comprising:

a plurality of electrical terminals; and a housing having the electrical terminals connected thereto, wherein the housing comprises a first housing member and a second housing member movably connected to the first housing member, wherein the first housing member comprises terminal receiving areas and snap-lock latches which lock the terminals in the terminal receiving areas, wherein the first and second housing members form a terminal position assurance feature, wherein the terminal receiving areas comprise a first row of the terminal receiving channels with a first one of the terminal receiving channels and a second one of the terminal receiving channels being separated from each other by a wall of the first housing member and the first housing member having a substantially open wall area between a third one of the terminal receiving channels and the second terminal receiving channel, wherein the second housing member is adapted to at least partially close the open wall area, wherein portions of the first and second housing members form contact lead-in surfaces to apertures into the terminal receiving channels at a front end of the housing, wherein the front end of the housing is adapted to mate with a mating electrical connector, and wherein at least one of the portions of the first and second housing members have a general cross-shape when viewed from the front end.

17. An electrical connector as in claim 16 wherein the TPA feature comprises blocking portions on the second housing member being adapted to be positioned in a gap between the snap-lock latches and another portion of the first housing member when the second housing member is moved from a forward unlocked position to a rearward locked position.

18. An electrical connector as in claim 16 wherein the terminal receiving channels comprise a second row of the terminal receiving channels which are substantially a mirror image of the first row.

19. An electrical connector as in claim 16 wherein each aperture has two of the lead-in surfaces formed by the first housing member and two of the lead-in surfaces formed by the second housing member.

20. An electrical connector comprising:

a plurality of electrical terminals; and a housing comprises a first housing member and a second housing member movably connected to the first housing member, wherein the housing comprises a plurality of individual terminal receiving channels arranged in at least two rows with the terminal receiving channels substantially aligned between the rows, wherein the first housing member and the second housing member cooperatively form portions of each individual terminal receiving channel, wherein the electrical terminals are connected to the housing and located in the terminal receiving channels, wherein a front side of the housing comprises a plurality of mating contact receiving apertures through the front side of the housing and into the terminal receiving channels, and wherein portions of the first and second housing members intermesh at the front side of the housing to cooperatively form each individual mating contact receiving aperture through the front side of the housing, wherein a first row of the terminal receiving channels comprises a first one of the terminal receiving channels and a second one of the terminal receiving channels being separated from each other only by a wall of the first housing member, and the first housing member having a substantially open wall area between a third one of the terminal receiving channels and the second terminal receiving channel, wherein the second housing member is adapted to at least partially close the open wall area between the second and third terminal receiving channels.

* * * * *

UNITED STATES PATENT AND TRADEMARK OFFICE

CERTIFICATE OF CORRECTION

PATENT NO. : 7,278,883 B2
APPLICATION NO. : 11/509968
DATED : October 9, 2007
INVENTOR(S) : Tyler It is certified that error appears in the above-identified patent and that said Letters Patent is hereby corrected as shown below:

In Claim 9: Column 6, line 51, delete "channels" and replace with --areas--.

Signed and Sealed this

Eighteenth Day of March, 2008

JON W. DUDAS
*Director of the United States Patent and Trademark Office*